US009905930B2

(12) United States Patent
Huang et al.

(10) Patent No.: US 9,905,930 B2
(45) Date of Patent: Feb. 27, 2018

(54) OMNI-DIRECTIONAL CEILING ANTENNA

(71) Applicant: CHINA UNITED NETWORK COMMUNICATIONS GROUP COMPANY LIMITED, Beijing (CN)

(72) Inventors: Xiaoming Huang, Beijing (CN); Xinliang Liu, Beijing (CN); Xinming Chen, Beijing (CN); Qiang Fu, Beijing (CN); Junbin Mo, Beijing (CN); Anmin Deng, Beijing (CN)

(73) Assignee: CHINA UNITED NETWORKS COMMUNICATIONS GROUP COMPANY LIMITED, Beijing (CN)

( * ) Notice: Subject to any disclaimer, the term of this patent is extended or adjusted under 35 U.S.C. 154(b) by 110 days.

(21) Appl. No.: 15/092,485

(22) Filed: Apr. 6, 2016

(65) Prior Publication Data

US 2016/0226149 A1 Aug. 4, 2016

Related U.S. Application Data

(63) Continuation of application No. PCT/CN2015/081186, filed on Jun. 10, 2015.

(30) Foreign Application Priority Data

Jun. 17, 2014 (CN) ..... 2014 1 0270634

(51) Int. Cl.
*H01Q 9/28* (2006.01)
*H01Q 1/00* (2006.01)
(Continued)

(52) U.S. Cl.
CPC ..... *H01Q 9/28* (2013.01); *H01Q 1/007* (2013.01); *H01Q 5/25* (2015.01); *H01Q 19/10* (2013.01); *H01Q 1/2291* (2013.01)

(58) Field of Classification Search
CPC H01Q 9/28; H01Q 5/25; H01Q 1/007; H01Q 19/10; H01Q 1/2291
(Continued)

(56) References Cited

U.S. PATENT DOCUMENTS

| | | | | |
|---|---|---|---|---|
| 7,408,521 | B2 | 8/2008 | Smith et al. | 343/773 |
| 2006/0022885 | A1 | 2/2006 | Ida et al. | 343/773 |

(Continued)

FOREIGN PATENT DOCUMENTS

| | | |
|---|---|---|
| CN | 2558099 Y | 6/2003 |
| CN | 202585725 U | 12/2012 |

OTHER PUBLICATIONS

Wang, Jianquan et al., "Coverage analysis and validation of a novel Sharing indoor distributional antenna" 2012 7th International ICST Conference on Communications and Networking in China, Aug. 2012, pp. 702-706.

(Continued)

*Primary Examiner* — Andrea Lindgren Baltzell
(74) *Attorney, Agent, or Firm* — J.C. Patents

(57) ABSTRACT

The present invention provides an omni-directional ceiling antenna, including: a cone cylinder-shaped radiation oscillator, a cone cylinder-shaped reflector, a disc cylinder-shaped base plate, and a dielectric ring; where the reflector includes a first hollow cone and a first cylindrical ring, a flared end of the first hollow cone is connected to the first cylindrical ring, and an outer diameter of the first cylindrical ring is smaller than that of the flared end of the first hollow cone; a second cylindrical ring is provided on the base plate, and the second cylindrical ring sockets to the first cylindrical ring to form a spatially separated coupling structure; the dielectric ring is provided between the second cylindrical ring and the first cylindrical ring so as to realize separation and fixed support between the reflector and the base plate.

7 Claims, 9 Drawing Sheets

(51) Int. Cl.

| | |
|---|---|
| ***H01Q 19/10*** | (2006.01) |
| ***H01Q 5/25*** | (2015.01) |
| *H01Q 1/22* | (2006.01) |

(58) Field of Classification Search
USPC ..... 343/790
See application file for complete search history.

(56) References Cited

U.S. PATENT DOCUMENTS

| | | | | |
|---|---|---|---|---|
| 2012/0176286 | A1 | 7/2012 | Amert et al. | 343/773 |
| 2013/0099995 | A1 | 4/2013 | Huang et al. | 343/872 |
| 2014/0118209 | A1 | 5/2014 | Yona | 343/775 |

OTHER PUBLICATIONS

Shi, Yanzhou et al., "Discussion on Technical norms of Indoor Distributional Antenna System" Telecommunications Technology, (2011), pp. 50-51.

Chinese First Examination Report of corresponding China patent Application No. 201410270634.9, dated Nov. 2, 2015.

The extended European Search Report of corresponding European application No. 15810230.1-1927, dated May 17, 2017.

The Australian Examination Report of corresponding Australian application No. 2015276754, dated Feb. 23, 2017.

OMNI-DIRECTIONAL CEILING ANTENNA

CROSS-REFERENCE TO RELATED APPLICATIONS

This application is a continuation of International Application No. PCT/CN2015/081186, filed on Jun. 10, 2015, which claims priority to Chinese Patent Application No. 201410270634.9, filed on Jun. 17, 2014, both of which are hereby incorporated by reference in their entireties.

TECHNICAL FIELD

The present invention relates to mobile communication technologies and, in particular, to an omni-directional ceiling antenna.

BACKGROUND

Mobile communication indoor omni-directional ceiling antennas, as a main antenna type for indoor wireless signal coverage, are widely used in indoor distribution systems, of which performance and quality have direct effects on quality of indoor wireless communications and investment efficiency of the indoor distribution system. The omni-directional ceiling antenna generally applies half-wave dipole principles, using a structure of a conical oscillator with a reflecting plate. The conical oscillator can extend impedance bandwidth of the antenna, and existing domestic omni-directional ceiling antennas also use impedance matching lines (sheets) connected between the radiation oscillator and the reflecting plate to reduce size and further extend bandwidth at lower frequency, which can satisfy a requirement that a voltage standing wave ratio (Voltage Standing Wave Ratio; VSWR for short) is less than 1.5 both in 806-960 MHz (low frequency band) and 1710-2500 MHz band or a wider frequency range. However, existing omni-directional ceiling antenna products do not take radiation pattern bandwidth properties into consideration, and have common technical defects, such as downward signals aggregation, i.e. high gains at small radiation angles and low gains at large radiation angles, and poor roundness of radiation pattern in the frequency band of 1710-2500 MHz. These defects in combination with loss characteristics that radio signals attenuate with frequency and propagation distance, result in that signals at a high frequency band, such as that of 3G and 4G, have strong electromagnetic radiation just under the antennas, and coverage thereof is far smaller than signals at a low frequency band, such as that of 2G. In fact, for indoor omni-directional ceiling antennas, a large radiation angle of 85° (taking vertically down as 0°, similarly hereinafter) is generally corresponding to the maximum coverage radius edge, and a small radiation angle of 30° is corresponding to a small vicinity area under antennas. In an indoor signal coverage scenario, it is expected that signal strength at the coverage radius edge should be strong enough to make the coverage more effective; and signal strength just under antennas should be as weak as possible to reduce the electromagnetic radiation. Thus, gains of indoor omni-directional antennas need to be modified by the radiation angle, so that properties thereof can be expounded exactly. High gain means strong coverage capacity at a large radiation angle, but strong radiation at a small radiation angle, whereas low gain means weak coverage capacity at a large radiation angle, but low electromagnetic radiation at a low radiation angle.

In order to solve problems described above, an omni-directional ceiling antenna with improved technique, which has special structures and certain dimensions of a cone-cylinder monopole and a discone reflecting plate without any impedance matching line(s), has been provided. The antenna improved radiation pattern properties at high frequency, ensured complete axial symmetry, and solved the problems of downward signals aggregation and poor roundness of radiation pattern in the frequency band of 1710-2500 MHz. The gain at a small low radiation angle of 30° is significantly reduced by 7-15 dB, the gain at a large radiation angle of 85° is increased by 3-6 dB, and both radiation pattern bandwidth and impedance bandwidth exceed 102%, which greatly improved coverage efficiency of high frequency signals, such as that of 3G.

However, with deployment of higher frequency networks, such as LTE/4G, the above omni-directional ceiling antenna with improved technique could not consider the problem of downward signals aggregation for even higher frequencies in LTE/4G. The radiation angle of maximum gain for frequencies above 2500 MHz directs about 60°, and the gain at 85° is reduced by up to 2 dB or so. The downward signals aggregation is still obvious which causes inefficient coverage of signals and high radiation just under the antenna at even higher frequencies in LTE/4G.

SUMMARY

The present invention provides an omni-directional ceiling antenna, which takes ultra-wideband properties of both impedance bandwidth and radiation pattern bandwidth into consideration to solve the problem of downward signals aggregation in the entire high frequency band (1710-2700 MHz) including mobile communications 2G, 3G and 4G, which can extend effective coverage of signals in the high frequency band to make the indoor signal coverage more uniform, and reduce the electromagnetic radiation under the antenna effectively to ensure the security of indoor electromagnetic environments.

The present invention provides an omni-directional ceiling antenna, including: a cone cylinder-shaped radiation oscillator, a cone cylinder-shaped reflector, a disc cylinder-shaped base plate, a hollow tubular wiring terminal, a dielectric ring and a feed cable; where a tip of the reflector faces toward a tip of the radiation oscillator, the tip of the radiation oscillator is connected with an inner conductor of the feed cable, and the tip of the reflector is connected to an outer conductor of the feed cable via the wiring terminal;

The reflector includes a first hollow cone and a first cylindrical ring, a flared end of the hollow cone is connected with the first cylindrical ring, and an outer diameter of the first cylindrical ring is smaller than that of the flared end of the first hollow cone;

A second cylindrical ring is provided on the base plate, and the second cylindrical ring sockets to the first cylindrical ring to form a spatially separated coupling structure;

The dielectric ring is provided between the second cylindrical ring and the first cylindrical ring to realize separation and fixed support between the reflector and the base plate.

The omni-directional ceiling antenna provided in the present invention further extends the radiation pattern bandwidth and the impedance bandwidth by changing the structure of the reflector, that is, the outer diameter of the first cylindrical ring in the reflector is smaller than that of the flared end of the first hollow cone in the reflector, thereby solving the problem of downward signals aggregation in the entire high frequency band (1710-2700 MHz), in particular, the frequency band of 2500-2700 MHz; the radiation angle with the maximum gain is adjusted to about 80°, which can extend the effective coverage of the antenna for the signals in the high frequency band, and make the indoor signal coverage more uniform. Meanwhile, the antenna adds the base plate having the disc cylinder structure, and the second cylindrical ring of the base plate sockets to the first cylindrical ring in the reflector to form a spatially separated coupling structure, so that the capacitance reactance on the bottom of the reflector is increased, and the current distribution on the surface of the reflector is changed. The electronic currents distributed on the reflector and the base plate have reserved phases, which further makes electromagnetic waves of the high frequency signals offset each other at the low radiation angle direction, thereby reducing the electromagnetic radiation under the antenna effectively and ensuring the security of indoor electromagnetic environments.

DESCRIPTION OF EMBODIMENTS

Figure 1:
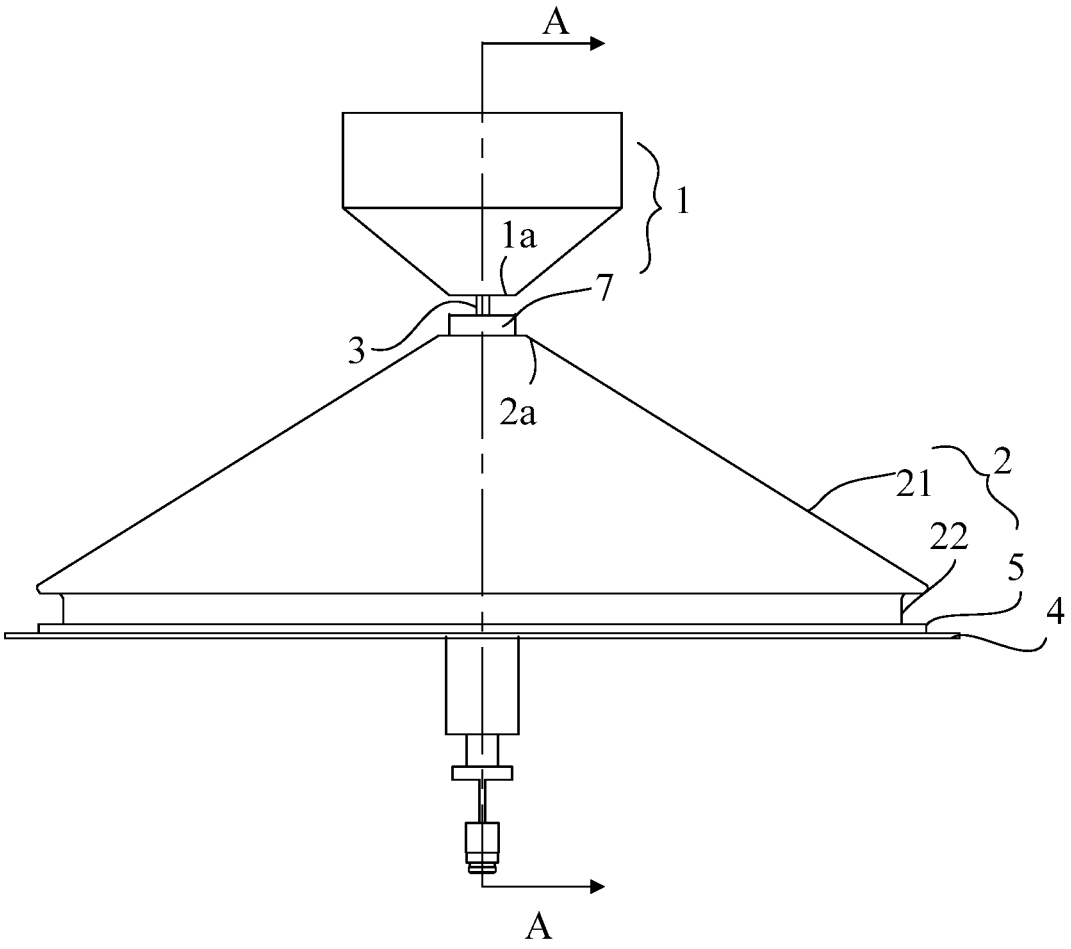
FIG. 1 shows a schematic diagram of an embodiment structure of an omni-directional ceiling antenna according to the present invention.

FIG. 1 shows a schematic diagram of an embodiment structure of an omni-directional ceiling antenna according to the present invention, which is the front view. As shown in FIG. 1, the omni-directional ceiling antenna in this embodiment includes: a cone cylinder-shaped radiation oscillator 1, a cone cylinder-shaped reflector 2, a disc cylinder-shaped base plate 4, a hollow tubular wiring terminal 7, and a feed cable 3; a tip 2*a* of the reflector 2 faces toward a tip 1*a* of the radiation oscillator 1, the center of the tip 1*a* of the radiation oscillator 1 is connected to an inner conductor of the feed cable 3, a central hole of the tip 2*a* of the reflector 2 is fixed with the wiring terminal 7 and is connected to an outer conductor of the feed cable 3 via the wiring terminal 7. The antenna also includes a dielectric ring 5. The reflector 2 includes a first hollow cone 21 and a first cylindrical ring 22, a flared end of the first hollow cone 21 is connected to the first cylindrical ring 22, and an outer diameter of the first cylindrical ring 22 is smaller than that of the flared end of the first hollow cone 21. A second cylindrical ring (which is not shown in FIG. 1, and is referenced in FIG. 8) is provided on the base plate 4, and the second cylindrical ring sockets to the first cylindrical ring 22 to form a spatially separated coupling structure. The dielectric ring 5 is provided between the second cylindrical ring and the first cylindrical ring 22 so as to realize separation and fixed support between the reflector 2 and the base plate 4.

Optionally, the antenna may further include a fixed kit (which is not shown in figures), a plastic cover, etc.

In this embodiment, the signal radiator of the antenna is formed by the radiation oscillator 1, the reflector 2 and the base plate 4. The radio frequency signal is fed from the feed cable 3, then passes the wiring terminal 7, and radiates toward surrounding space from between the tip 1*a* of the radiation oscillator 1 and the tip 2*a* of the reflector 2. For low frequency signals (806-960 MHz), the radiation oscillator 1 with a cone cylinder structure, the reflector 2, and the base plate 4 form an asymmetric half-wave dipole, a radiation pattern has the maximum gain in the direction of a radiation angle of 90° (horizontal); for high frequency signals (1710-2700 MHz), a relative electrical length of the asymmetric dipole exceeds ½ wavelength, the radiation pattern lobes usually split, and the radiation angle with the maximum gain reduces as the frequency increases, which causes that the high frequency signals are aggregated under the antenna. However, in the present invention, since the tips of tapered sections of the reflector 2 and the radiation oscillator 1 are disposed opposite to each other, which are equivalent to a biconical antenna for high frequency signals, the problem of downward signals aggregation at high frequencies existing with conventional omni-directional ceiling antennas is changed, and gains at large radiation angles are increased. The radiation angle with the maximum gain is adjusted to about 80°, which can extend effective coverage of signals in the high frequency band and make the indoor signal coverage more uniform. Thereby an ultra-wideband antenna is formed which has the same radiation patterns basically at working frequencies including high and low frequency bands.

Furthermore, the antenna in this embodiment adds the base plate 4 having the disc cylinder structure, and the second cylindrical ring of the base plate 4 sockets to the first cylindrical ring 22 in the reflector 2 to form a spatially separated coupling structure, so that the capacitance reactance on the bottom of the reflector 2 is increased, and the current distribution on the surface of the reflector 2 is changed. The electronic currents distributed on the reflector 2 and the base plate 4 have reserved phases, which further makes electromagnetic waves of the high frequency signals offset each other at the low radiation angle direction, thereby reducing the electromagnetic radiation under the antenna effectively and ensuring the security of indoor electromagnetic environments. The degree of coupling between the reflector 2 and the base plate 4 is adjusted by changing the height of the second cylindrical ring on the base plate 4, and/or a way in which the reflector 2 sockets to the base plate 4 and the gap therebetween. Low radiation angle gains of the antenna at different frequency points in the high frequency band are adjusted, which can optimize gains at the low radiation angles over the entire high frequency band.

In order to further illustrate beneficial effects of the omni-directional ceiling antenna according to the present invention, details at frequency points of 806 MHz, 870 MHz, 960 MHz, 1710 MHz, 1795 MHz, 1880 MHz, 1920 MHz, 1990 MHz, 2170 MHz, 2300 MHz, 2400 MHz, 2500

Figure 2:
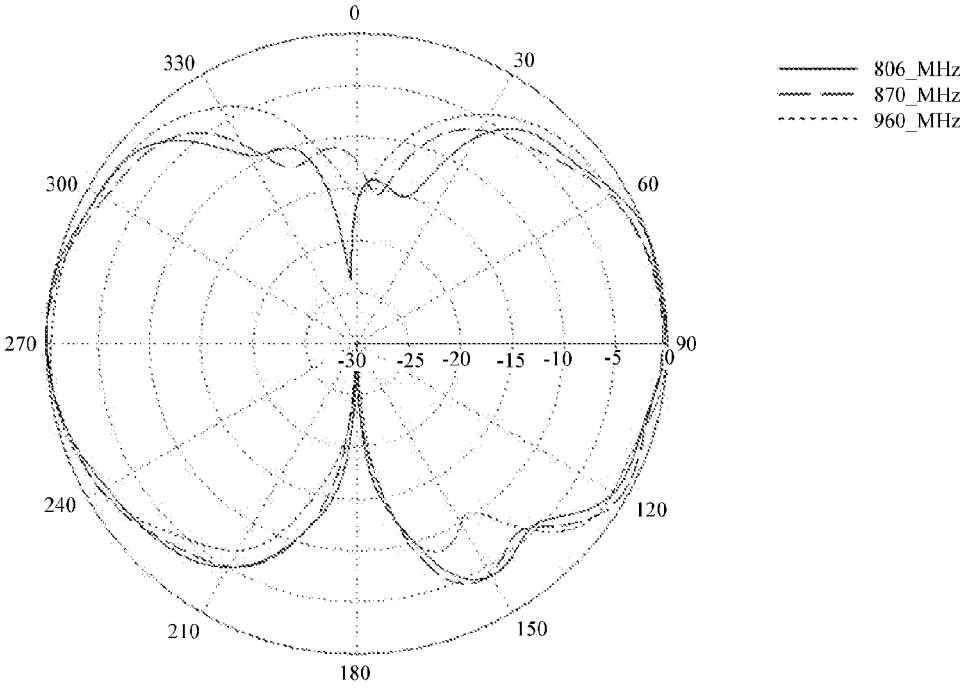
FIG. 2 shows E-plane radiation patterns at frequency points of 806, 870 and 960 MHz in a low frequency band.
Figure 3:
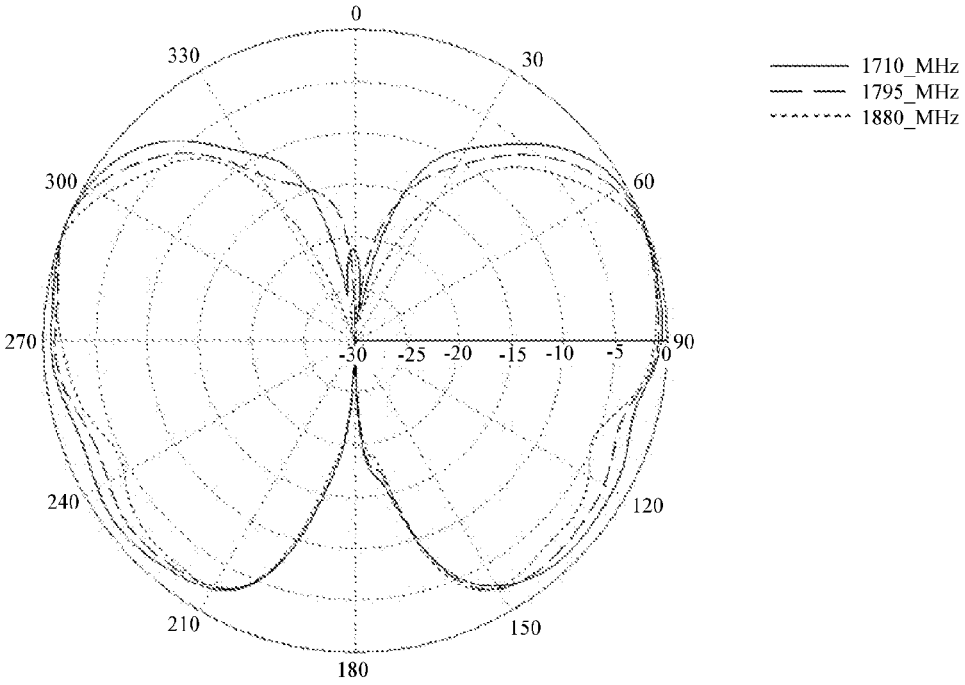
FIG. 3 shows E-plane radiation patterns at frequency points of 1710, 1795 and 1880 MHz in a high frequency band.
Figure 4:
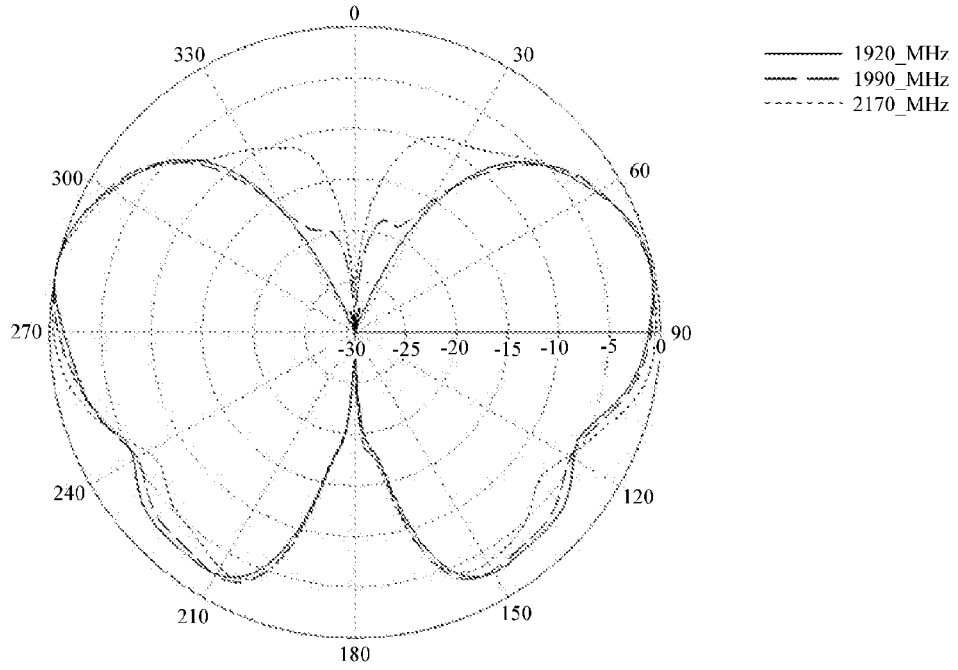
FIG. 4 shows E-plane radiation patterns at frequency points of 1920, 1990 and 2170 MHz in the high frequency band.
Figure 5:
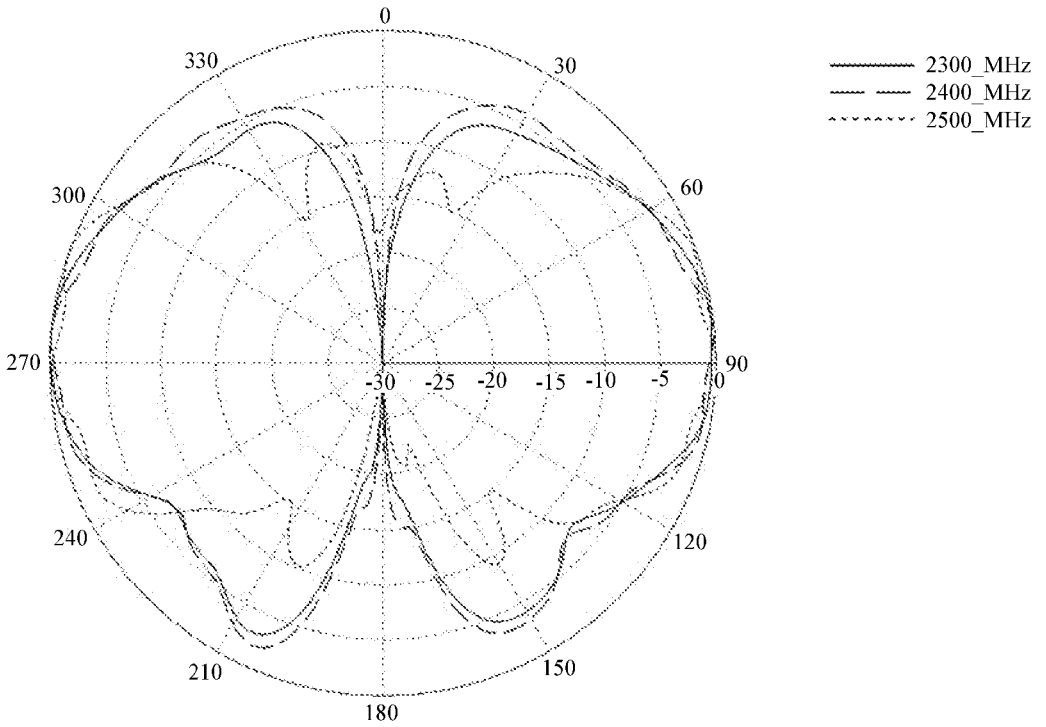
FIG. 5 shows E-plane radiation patterns at frequency points of 2300, 2400 and 2500 MHz in the high frequency band.
Figure 6:
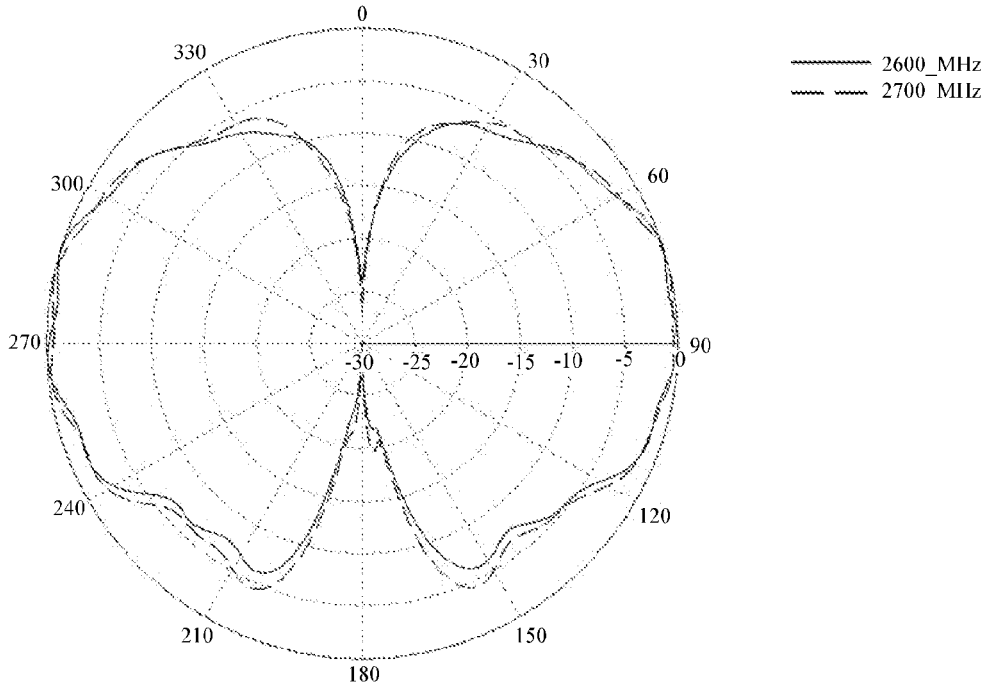
FIG. 6 shows E-plane radiation patterns at a frequency point of 2600 and a frequency point of 2700 MHz in the high frequency band.
Figure 7:
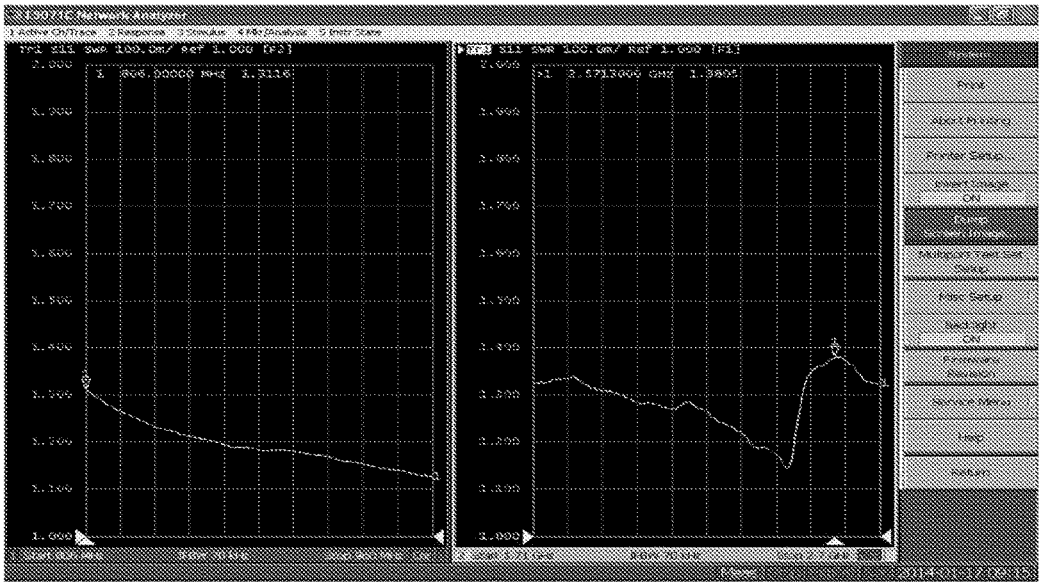
FIG. 7 shows a graph of voltage standing wave ratio versus frequency of an omni-directional ceiling antenna.

MHz, 2600 MHz and 2700 MHz are given about major technical indicators in this embodiment, such as measured gain, roundness of radiation pattern, E-plane radiation pattern, voltage standing wave ratio, and third-order intermodulation, etc. FIG. 2 shows E-plane radiation patterns at frequency points of 806, 870 and 960 MHz in the low frequency band; FIG. 3 shows E-plane radiation patterns at frequency points of 1710, 1795 and 1880 MHz in the high frequency band; FIG. 4 shows E-plane radiation patterns at frequency points of 1920, 1990 and 2170 MHz in the high frequency band; FIG. 5 shows E-plane radiation patterns at frequency points of 2300, 2400 and 2500 MHz in the high frequency band; FIG. 6 shows E-plane radiation patterns at frequency points of 2600 and 2700 MHz in the high frequency band; and FIG. 7 shows a graph of voltage standing wave ratio versus frequency of an the omni-directional ceiling antenna.

Table 1 shows measured results of major technical indicators such as gains (30° and 85°) at each frequency point, roundness of radiation pattern (85°), voltage standing wave ratio, and third-order intermodulation.

Detect results of embodiment samples show that, compared with the omni-directional ceiling antenna in the prior art, the omni-directional ceiling antenna according to the present invention has the maximum gain at the radiation angle of about 80°. When the radiation angle θ=85°, gains of signals in the low frequency band (806-960 MHz) are the same basically. Gains of signals in the high frequency band (1710-2700 MHz) are increased significantly, meanwhile the gains at a low radiation angle equal to or less than 30° in the high frequency band (1710-2700 MHz) are reduced, which can improve coverage efficiency of the high frequency signals and reduce indoor electromagnetic radiation intensity. Moreover, voltage standing wave ratios are less than 1.5 in the frequency band of 806-960 MHz and 1710-2700 MHz, and ultra-wideband properties of radiation pattern bandwidth and impedance bandwidth are realized. Relative bandwidth reaches 108%, gains of signals in the frequency band of 2500-2700 MHz are improved significantly in a direction of a high radiation angle, and gains of signals in the low frequency band, in particular, the frequency band of 1710-2170 MHz, are further reduced in a direction of a low radiation angle. The consistent coverage of 2G, 3G and LTE/4G signals is realized, and the radiation intensity in indoor electromagnetic environments is reduced effectively.

TABLE 1

| Frequency | | Gains at radiation angles (dBi) | | | | Roundness of radiation pattern at radiation angle of 85° (dB) | | Voltage standing wave ratio | Third-order intermodulation (dBc) | |
|---|---|---|---|---|---|---|---|---|---|---|
| Frequency band | Frequency point (MHz) | 30° | 85° | 30° Average | 85° Average | Each frequency point | Average value | | Frequency band | Measured value |
| Low frequency band | 806 | −5.00 | 2.00 | −2.02 | 1.79 | 1.03 | 0.34 | 1.31 | CDMA | −157.9 |
| | 824 | −0.65 | 1.98 | | | 1.35 | | | | |
| | 840 | −0.87 | 1.58 | | | 0.92 | | | | |
| | 870 | −3.93 | 2.06 | | | 1.99 | | | GSM | −164.76 |
| | 900 | −1.12 | 1.78 | | | 1.44 | | | | |
| | 930 | −1.08 | 1.20 | | | 1.05 | | | | |
| | 960 | −1.48 | 1.90 | | | 0.80 | | | | |
| High frequency band | 1710 | −6.98 | 1.19 | −7.42 | 2.40 | 1.23 | 0.28 | 1.38 | DCS | −166.06 |
| | 1795 | −8.41 | 1.38 | | | 0.15 | | | | |
| | 1880 | −10.62 | 2.26 | | | 0.26 | | | | |
| | 1920 | −13.90 | 2.63 | | | 0.21 | | | WCDMA | −163.8 |
| | 1990 | −12.59 | 2.66 | | | 0.25 | | | | |
| | 2045 | 10.73 | 2.78 | | | 0.24 | | | | |
| | 2170 | −5.23 | 3.34 | | | 0.20 | | | | |
| | 2300 | −3.00 | 2.88 | | | 0.11 | | | — | — |
| | 2400 | −1.59 | 2.39 | | | 0.26 | | | | |
| | 2500 | −8.41 | 3.18 | | | 0.21 | | | | |
| | 2600 | −4.16 | 2.23 | | | 0.59 | | | | |
| | 2700 | −3.37 | 1.88 | | | 0.48 | | | | |

Note:
Input power of a test signal for the third-order intermodulation: 2 × 33 dBm In this embodiment, the radiation pattern bandwidth and the impedance bandwidth are further extended by shrinking the cylindrical ring of the reflector (that is, the outer diameter of the first cylindrical ring in the reflector is smaller than that of the flared end of the first hollow cone). The problem of downward signals aggregation in the entire high frequency band (1710-2700 MHz), in particular, the frequency band of 2500-2700 MHz is solved; the radiation angle with the maximum gain is adjusted to about 80°, which can extend the effective coverage of the antenna for the signals in the high frequency band, and make the indoor signal coverage more uniform. Meanwhile, the antenna adds the base plate having the disc cylinder structure, and the second cylindrical ring of the base plate sockets to the first cylindrical ring in the reflector to form a spatially separated coupling structure, so that the capacitance reactance on the bottom of the reflector is increased, and the current distribution on the surface of the reflector is changed. The electronic currents distributed on the reflector and the base plate have reserved phases, which further makes electromagnetic waves of the high frequency signals offset each other at the low radiation angle direction, thereby reducing the electromagnetic radiation under the antenna effectively and ensuring the security of indoor electromagnetic environments.

Figure 8:
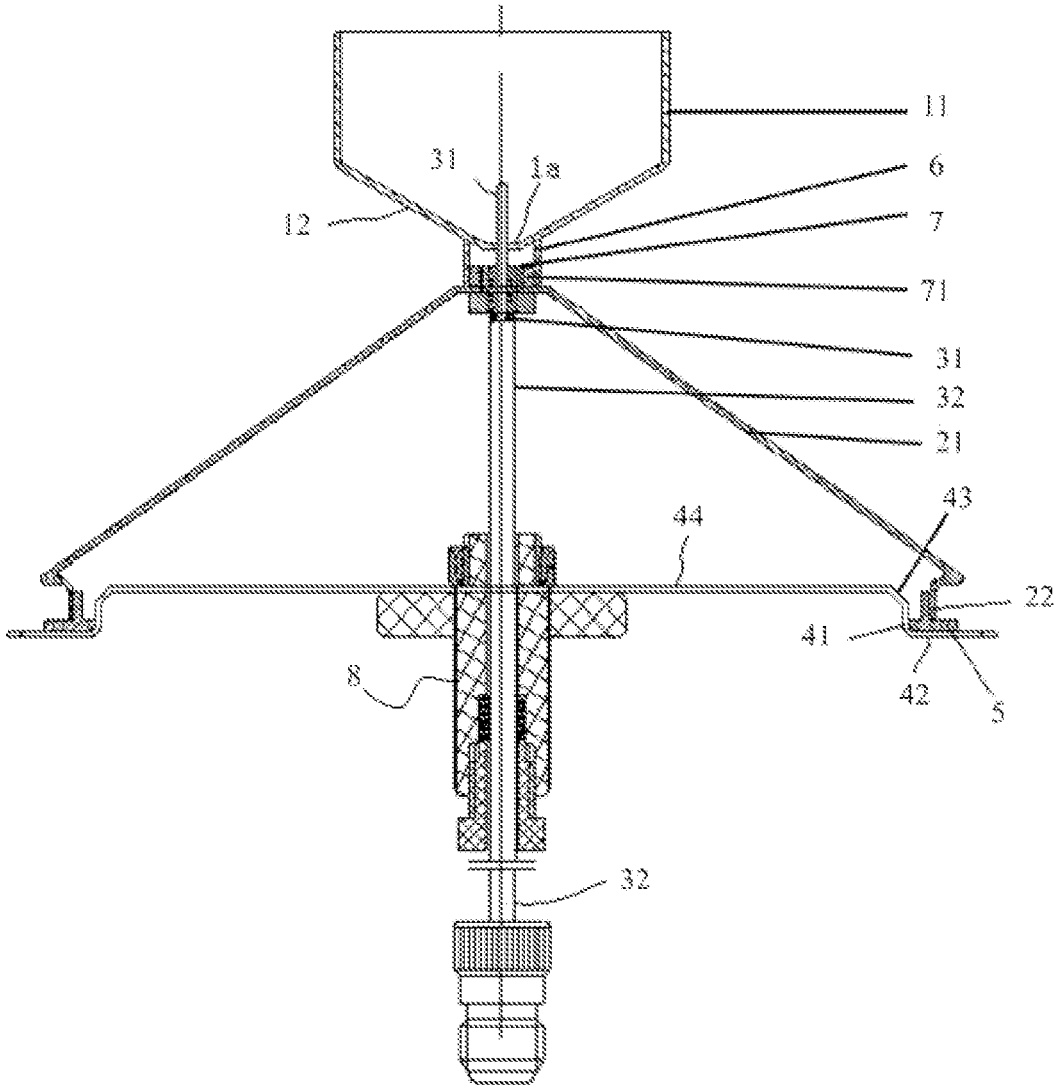
FIG. 8 shows a cross-sectional view of FIG. 1 along A-A.

Furthermore, in another embodiment of the present invention, FIG. 8 shows a cross-sectional view of FIG. 1 along A-A, which is based on the embodiment 1 as shown in FIG.

1. In this embodiment, the radiation oscillator 1 includes a third cylindrical ring 11 and a third hollow cone 12, and the flared end of the third hollow cone 12 is connected to the third cylindrical ring 11, that is, the outer diameter of the third cylindrical ring 11 is the same as the outer diameter of the circle at the bottom of the flared end of the third hollow cone 12.

Furthermore, optionally, the antenna may also include a dielectric sleeve 6 disposed between the tip 1*a* of the radiation oscillator 1 and the tip 2*a* of the reflector 2 so as to realize the separation and fixed support between the radiation oscillator 1 and the reflector 2.

Optionally, the flared end of the first hollow cone 21 is connected to the first cylindrical ring 22, and the outer diameter of the circle at the bottom of the flared end of the first hollow cone 21 is larger than the outer diameter of the first cylindrical ring 22.

The base plate 4 is provided with a disc ring 42 at its edge, and the inner edge of the disc ring 42 is connected to the second cylindrical ring 41. The second cylindrical ring 41 sockets to the first cylindrical ring 22 of the reflector 2, and is separated and fixed via the dielectric ring 5 to form a spatially separated coupling structure.

Optionally, in order to facilitate one-time stamp-forming and reduce production costs effectively, the base plate 4 is designed in a center-projected disc shape, which includes the second cylindrical ring 41, the disc ring 42, a chamfer 43 and a disc bottom 44, where the disc bottom 44 has a hole at the center to connect a plastic fixed kit 8 and make the feed cable 3 passing through conveniently.

Furthermore, the center of the tip 1*a* of the radiation oscillator 1 is connected to an inner conductor 31 of the feed cable 3. An end of the wiring terminal 7 passes through the central hole of the tip 2*a* of the reflector 2, and is tightly connected to the tip 2*a* of the reflector 2 via a fixing nut 71, and another end of the wiring terminal 7 is connected to an outer conductor 32 of the feed cable 3.

More specifically, the feed cable 3 can use a 50 ohm coaxial cable. The feed cable 3 passes through the central hole of the fixed kit 8, the plastic protective jacket and an outer conductor layer of the cable are peeled off, and the insulation layer and the inner conductor 31 are passing through the hollow wiring terminal. The inner conductor 31 is welded to the radiation oscillator 1, and the outer conductor 32 of the feed cable 3 is electrically connected to the end of the wiring terminal 7.

In this embodiment, spatially separated coupling structure is formed by shrinking a cylindrical ring of the reflector (that is, the outer diameter of the first cylindrical ring in the reflector is smaller than that of the flared end of the first hollow cone in the reflector), adding the base plate in the antenna, and socketing the second cylindrical ring on the base plate to the first cylindrical ring in the reflector. The radiation pattern bandwidth and impedance bandwidth are further extended, thereby solving the problem of downward signals aggregation in the high frequency band 2500-2700 MHz particularly, which exists in the conventional omni-directional ceiling antenna and the improved omni-directional ceiling antenna. Both the radiation pattern bandwidth and the impedance bandwidth reach 108%, and gains of signals in the frequency band of 1710-2500 MHz are further improved at high radiation angles. Compared with the traditional omni-directional ceiling antenna in the prior art, gains of signals in the low frequency band (806~960 MHz) are the same basically when the radiation angle is 85°. Gains of signals in the high frequency band (1710-2700 MHz) are increased significantly when the radiation angle$\theta$=85°, and gains at a low radiation angle equal to or less than 30° are reduced. The roundness of the radiation pattern of the antenna is improved, which makes signal coverage more uniform and extends effective coverage of the high frequency signals. The consistent coverage of 2G, 3G and LTE/4G signals is realized, and the radiation intensity in indoor electromagnetic environments is reduced effectively.

It should also be noted that, the antenna in the present invention also realizes impedance bandwidth properties of ultra-wideband over the entire band of 806-2700 MHz. The spatially separated coupling structure is formed by shrinking a cylindrical ring of the reflector (that is, the outer diameter of the first cylindrical ring in the reflector is smaller than that of the flared end of the first hollow cone in the reflector), adding a base plate in the antenna, and socketing a second cylindrical ring on the base plate to a first cylindrical ring in the reflector. The ultra-wideband property of radiation pattern bandwidth and the property of reducing electromagnetic radiation under the antenna effectively are realized. Meanwhile, the better roundness of radiation pattern is ensured because of removing the impedance matching lines (sheets) and the completely axially symmetrical in structure.

Furthermore, the antenna has a simple structure and a good integrity. The radiation oscillator 1, the reflector 2 and the base plate 4 may be integrally molded, which are easy to manufacture by stamping. Because of advantages such as compact structure, simple assembly, less welding points and adjustment-free, the antenna has a broad application prospect in indoor distribution systems of mobile communication networks.

Figure 9A:
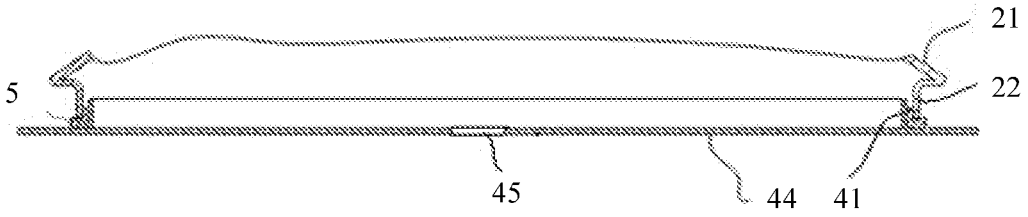
FIG. 9*a* and FIG. 9*b* show local schematic diagrams of another embodiment of an omni-directional ceiling antenna according to the present invention, respectively.
Figure 9B:
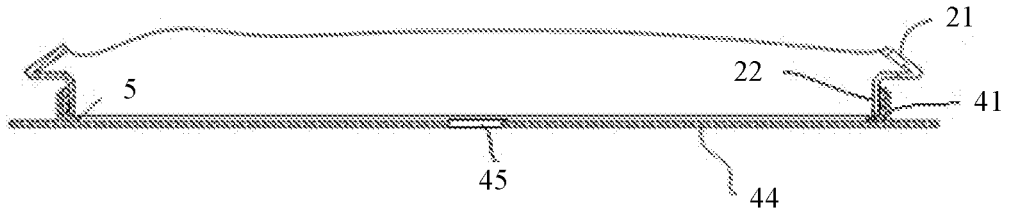

FIG. 9*a* and FIG. 9*b* show local schematic diagrams of another embodiment of an omni-directional ceiling antenna according to the present invention, respectively. Based on the embodiment as shown in FIG. 8, this embodiment differs from the embodiment as shown in FIG. 8 in that, there isn't a chamfer 43 for transition between the disc bottom 44 and the second cylindrical ring 41.

Specifically, as shown in FIG. 9*a*, the base plate 4 includes two parts: the disc bottom 44 and the second cylindrical ring 41 connected thereon. The second cylindrical ring 41 sockets to the inner side of the first cylindrical ring 22, and is spatially separated via the dielectric ring 5. A central hole 45 of the disc bottom 44 is configured to connect the plastic fixed kit, and make the feed cable 3 passing through conveniently.

As shown in FIG. 9*b*, the base plate 4 includes two parts: the disc bottom 44 and the second cylindrical ring 41 connected thereon. The second cylindrical ring 41 sockets to the outer side of the first cylindrical ring 22, and is spatially separated via the dielectric ring 5. The central hole 45 of the disc bottom 44 is configured to connect the plastic fixed kit, and make the feed cable 3 passing through conveniently.

Figure 10A:
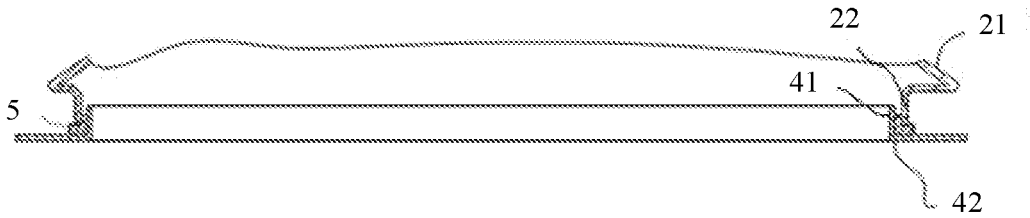
FIG. 10*a* and FIG. 10*b* show local schematic diagrams of another embodiment of an omni-directional ceiling antenna according to the present invention respectively.
Figure 10B:
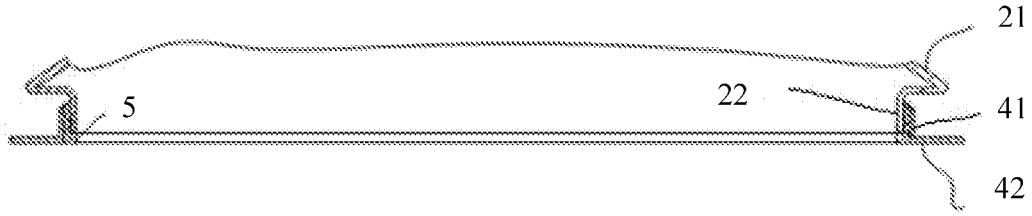

FIG. 10*a* and FIG. 10*b* show local schematic diagrams of another embodiment structure of an omni-directional ceiling antenna according to the present invention respectively. Based on the embodiment as shown in FIG. 8, this embodiment differs from the embodiment as shown in FIG. 8 in that, the base plate 4 is in a circular ring shape, and is composed of the second cylindrical ring 41 and the disc ring 42 connected thereto.

Specifically, as shown in FIG. 10*a*, the second cylindrical ring 41 sockets to the inner side of the first cylindrical ring 22, and is spatially separated via the dielectric ring 5.

As shown in FIG. 10*b*, the second cylindrical ring 41 sockets to the outer side of the first cylindrical ring 22, and is spatially separated via the dielectric ring 5.

Furthermore, in another embodiment of the present invention, based on embodiments above, the radiation oscillator 1 has a height of 35-45 mm. The heights of the third cylindrical ring 11 and the third hollow cone 12 are half of the height of the radiation oscillator 1 respectively. Moreover, the taper angle of the third hollow cone 12 is 30-35 degrees. In addition, the tip of the third hollow cone 12 is opened at the center, and the diameter of the hole is 0.5-2 mm.

Optionally, the height of reflector 2 is 53-55 mm, and the diameter is 170-178 mm. The tip of the first hollow cone 21 is opened at the center, and the outer diameter at its bottom of the first hollow cone is 170-173 mm. The outer diameter of the first cylindrical ring 22 is 160-163 mm and the height is 5-7 mm.

Optionally, the base plate 4 has a hollow discone structure. The conical section bulges from the middle of the disc, and has a hole in the center. The diameter of the hole is 4-6 mm, and the hole is tightly connected to the outer conductor 32 of the feed cable 3. The outer diameter of the bulged cone is slightly smaller than the inner diameter of the hollow cylinder (that is, the first cylindrical ring 22) of the reflector 2, and is about 150-153 mm.

Optionally, in this embodiment, the cover of the antenna can be molded by using an acrylonitrile butadiene styrene copolymers (Acrylonitrile butadiene Styrene copolymers; ABS for short) material. Snap connection is used between the cover and the base plate of the antenna, which can realize simple installation and fixed connection.

Furthermore, optionally, the radiation oscillator 1 can be molded by using an aluminum sheet having a thickness of 0.5-2 mm, and the dielectric ring 5 can also be molded by using the ABS material.

It should also be noted that, in order to reduce the processing cost, other metal components can also be stamped by using the aluminum sheet.

Finally, it should be noted that the foregoing embodiments are merely used for describing the technical solution of the present invention rather than limiting the present invention. Although the present invention is described in detail with reference to the foregoing embodiments, persons of ordinary skill in the art should understand that they also can modify the technical solution described in the foregoing embodiments, or replace some or all technical features equivalently. However, these modifications or replacements do not make the nature of the corresponding technical solutions departing from the scope of the technical solutions in the embodiments of the present invention.

What is claimed is:

1. An omni-directional ceiling antenna, comprising a cone cylinder-shaped radiation oscillator, a cone cylinder-shaped reflector, a disc cylinder-shaped base plate, a hollow tubular wiring terminal, a dielectric ring and a feed cable;

wherein a tip of the reflector faces toward a tip of the radiation oscillator, the tip of the radiation oscillator is connected to an inner conductor of the feed cable, and the tip of the reflector is connected to an outer conductor of the feed cable via the wiring terminal;

the reflector comprises a first hollow cone and a first cylindrical ring, a flared end of the first hollow cone is connected to the first cylindrical ring, and an outer diameter of the first cylindrical ring is smaller than that of the flared end of the first hollow cone;

a second cylindrical ring is provided on the base plate, and the second cylindrical ring sockets to the first cylindrical ring to form a spatially separated coupling structure;

the dielectric ring is provided between the second cylindrical ring and the first cylindrical ring to realize separation and fixed support between the reflector and the base plate.

2. The omni-directional ceiling antenna according to claim 1, wherein the base plate is provided with a disc ring at its edge, and an inner edge of the disc ring is connected to the second cylindrical ring.

3. The omni-directional ceiling antenna according to claim 2, wherein the base plate further comprises a chamfer and a disc bottom; wherein an edge of the disc bottom is connected to an end of the chamfer, and another end of the chamfer is connected to the second cylindrical ring.

4. The omni-directional ceiling antenna according to claim 1, further comprising: a dielectric sleeve disposed between the radiation oscillator and the reflector, so that the separation and the fixed support are realized between the radiation oscillator and the reflector via the dielectric sleeve.

5. The omni-directional ceiling antenna according to claim 1, wherein the radiation oscillator comprises a third hollow cone and a third cylindrical ring; a flared end of the third hollow cone is connected to the third cylindrical ring.

6. The omni-directional ceiling antenna according to claim 5, wherein a height of the radiation oscillator is 35-45 mm, and a taper angle of the third hollow cone is 30-35 degrees.

7. The omni-directional ceiling antenna according to claim 1, wherein:

an outer diameter of the first hollow cone at a bottom thereof is 170-173 mm; an outer diameter of the first cylindrical ring is 160-163 mm and a height thereof is 5-7 mm.

* * * * *